US010114396B2

(12) United States Patent
Tsai et al.

(10) Patent No.: US 10,114,396 B2
(45) **Date of Patent: *Oct. 30, 2018**

(54) INDUCTION TYPE POWER SUPPLY SYSTEM AND INTRUDING METAL DETECTION METHOD THEREOF

(71) Applicant: Fu Da Tong Technology Co., Ltd., New Taipei (TW)

(72) Inventors: Ming-Chiu Tsai, New Taipei (TW); Chi-Che Chan, New Taipei (TW)

(73) Assignee: Fu Da Tong Technology Co., Ltd., New Taipei (TW)

( * ) Notice: Subject to any disclaimer, the term of this patent is extended or adjusted under 35 U.S.C. 154(b) by 276 days.

This patent is subject to a terminal disclaimer.

(21) Appl. No.: 15/005,014

(22) Filed: Jan. 25, 2016

(65) Prior Publication Data

US 2016/0139618 A1 May 19, 2016

(30) Foreign Application Priority Data

Oct. 28, 2015 (TW) ..... 104135327 A

(51) Int. Cl.
*G05D 5/00* (2006.01)
*G05F 1/66* (2006.01)

(52) U.S. Cl.
CPC ..... *G05F 1/66* (2013.01)

(58) Field of Classification Search
CPC ..... G05F 1/66
USPC ..... 700/292
See application file for complete search history.

(56) References Cited

U.S. PATENT DOCUMENTS

| | | | |
|---|---|---|---|
| 4,393,516 | A | 7/1983 | Itani |
| 5,270,998 | A | 12/1993 | Uchiumi |
| 7,720,452 | B2 | 5/2010 | Miyahara |
| 7,939,963 | B2 | 5/2011 | Chang |
| 8,072,310 | B1 | 12/2011 | Everhart |
| 8,217,621 | B2 | 7/2012 | Tsai |
| 8,412,963 | B2 | 4/2013 | Tsai |

(Continued)

FOREIGN PATENT DOCUMENTS

| | | | |
|---|---|---|---|
| CN | 1142649 | A | 2/1997 |
| CN | 1476535 | A | 2/2004 |

(Continued)

OTHER PUBLICATIONS

Yang, "A Multi-Coil Wireless Charging System with Parasitic Mental Detection", Donghua University Master Dissertation, China Master's Theses Full-text Database, Engineering Technology II, vol. 09, May 2014.

*Primary Examiner* — Hoai V Ho
(74) *Attorney, Agent, or Firm* — Winston Hsu

(57) ABSTRACT

A method used for an induction type power supply system, for detecting whether an intruding metal exists in a power transmission region of the induction type power supply system, includes interrupting at least one driving signal of the induction type power supply system to stop driving a supplying-end coil of the induction type power supply system; detecting an attenuation status of a coil signal on the supplying-end coil when driving of the supplying-end coil is interrupted; and determining whether the intruding metal exists in the power transmission region of the induction type power supply system according to the attenuation status of the coil signal.

8 Claims, 14 Drawing Sheets

(56) References Cited

U.S. PATENT DOCUMENTS

| | | | | |
|---|---|---|---|---|
| 8,417,359 | B2 | 4/2013 | Tsai | |
| 8,422,420 | B1 | 4/2013 | Gulasekaran | |
| 8,731,116 | B2 | 5/2014 | Norconk | |
| 8,772,979 | B2 | 7/2014 | Tsai | |
| 8,810,072 | B2 | 8/2014 | Tsai | |
| 9,048,881 | B2 | 6/2015 | Tsai | |
| 9,075,587 | B2 | 7/2015 | Tsai | |
| 2003/0123168 | A1 | 7/2003 | Yokomizo | |
| 2005/0076102 | A1 | 4/2005 | Chen | |
| 2008/0030398 | A1 | 2/2008 | Nakamura | |
| 2009/0026844 | A1 | 1/2009 | Iisaka | |
| 2009/0271048 | A1 | 10/2009 | Wakamatsu | |
| 2009/0284082 | A1 | 11/2009 | Mohammadian | |
| 2009/0302800 | A1 | 12/2009 | Shiozaki | |
| 2010/0098177 | A1 | 4/2010 | Hamaguchi | |
| 2010/0237943 | A1 | 9/2010 | Kim | |
| 2010/0270867 | A1 | 10/2010 | Abe | |
| 2010/0277003 | A1 | 11/2010 | Von Novak | |
| 2011/0196544 | A1 | 8/2011 | Baarman | |
| 2012/0153739 | A1 | 6/2012 | Cooper | |
| 2012/0242159 | A1 | 9/2012 | Lou | |
| 2012/0272076 | A1 | 10/2012 | Tsai | |
| 2012/0293009 | A1 | 11/2012 | Kim | |
| 2013/0015705 | A1* | 1/2013 | Abe | H02J 5/005 307/29 |
| 2013/0049484 | A1 | 2/2013 | Weissentern | |
| 2013/0162054 | A1 | 6/2013 | Komiyama | |
| 2013/0162204 | A1 | 6/2013 | Jung | |
| 2013/0175873 | A1 | 7/2013 | Kwon | |
| 2013/0175937 | A1 | 7/2013 | Nakajo | |
| 2013/0176023 | A1 | 7/2013 | Komiyama | |
| 2013/0187476 | A1* | 7/2013 | Tsai | H02J 17/00 307/104 |
| 2013/0267213 | A1 | 10/2013 | Hsu | |
| 2013/0342027 | A1 | 12/2013 | Tsai | |
| 2014/0024919 | A1 | 1/2014 | Metzenthen | |
| 2014/0077616 | A1 | 3/2014 | Baarman | |
| 2014/0084857 | A1 | 3/2014 | Liu | |
| 2014/0152251 | A1 | 6/2014 | Kim | |
| 2014/0184152 | A1 | 7/2014 | Van Der Lee | |
| 2014/0355314 | A1 | 12/2014 | Ryan | |
| 2015/0008756 | A1 | 1/2015 | Lee | |
| 2015/0028875 | A1 | 1/2015 | Irie | |
| 2015/0044966 | A1 | 2/2015 | Shultz | |
| 2015/0054355 | A1 | 2/2015 | Ben-Shalom | |
| 2015/0123602 | A1 | 5/2015 | Patino | |
| 2015/0162054 | A1 | 6/2015 | Ishizu | |
| 2015/0162785 | A1 | 6/2015 | Lee | |
| 2015/0285926 | A1 | 10/2015 | Oettinger | |
| 2016/0241086 | A1* | 8/2016 | Jung | H02J 50/12 |
| 2016/0349782 | A1* | 12/2016 | Tsai | G05F 1/66 |

FOREIGN PATENT DOCUMENTS

| | | | |
|---|---|---|---|
| CN | 1930790 | A | 3/2007 |
| CN | 101106388 | A | 1/2008 |
| CN | 101834473 | A | 9/2010 |
| CN | 101907730 | A | 12/2010 |
| CN | 101924399 | A | 12/2010 |
| CN | 101978571 | A | 2/2011 |
| CN | 102055250 | A | 5/2011 |
| CN | 102157991 | A | 8/2011 |
| CN | 102474133 | A | 5/2012 |
| CN | 102804619 | A | 11/2012 |
| CN | 102904475 | A | 1/2013 |
| CN | 103069689 | A | 4/2013 |
| CN | 103248130 | A | 8/2013 |
| CN | 103425169 | A | 12/2013 |
| CN | 103457361 | A | 12/2013 |
| CN | 103852665 | A | 6/2014 |
| CN | 103975497 | A | 8/2014 |
| CN | 104521151 | A | 4/2015 |
| CN | 104685760 | A | 6/2015 |
| CN | 104734370 | A | 6/2015 |
| CN | 105049008 | A | 11/2015 |
| CN | 105449875 | A | 3/2016 |
| CN | 205105005 | U | 3/2016 |
| EP | 2608419 | A2 | 6/2013 |
| EP | 2 793 355 | A1 | 10/2014 |
| JP | 200660909 | A | 3/2006 |
| JP | 2008206305 | A | 9/2008 |
| JP | 2010213414 | A | 9/2010 |
| JP | 2013135518 | A | 7/2013 |
| JP | 2014171371 | A | 9/2014 |
| JP | 2017511117 | A | 4/2017 |
| KR | 100650628 | B1 | 11/2006 |
| TW | 201034334 | A1 | 9/2010 |
| TW | I389416 | | 3/2013 |
| TW | I408861 | | 9/2013 |
| TW | 201414130 | | 4/2014 |
| TW | 201415752 | | 4/2014 |
| TW | 201440368 | A | 10/2014 |
| TW | I459676 | B | 11/2014 |
| TW | I472897 | | 2/2015 |
| TW | I483509 | B | 5/2015 |
| WO | 2013043974 | A2 | 3/2013 |
| WO | 2015154086 | A1 | 10/2015 |

* cited by examiner

INDUCTION TYPE POWER SUPPLY SYSTEM AND INTRUDING METAL DETECTION METHOD THEREOF

BACKGROUND OF THE INVENTION

1. Field of the Invention

The present invention relates to a method used for an induction type power supply system, and more particularly, to a method capable of detecting whether an intruding metal exists in a power transmission region of an induction type power supply system.

2. Description of the Prior Art

In an induction type power supply system, a power supply device applies a driver circuit to drive a supplying-end coil to generate resonance, in order to send electromagnetic waves. A coil of the power receiving device may receive the electromagnetic waves and perform power conversion to generate DC power to be supplied for the device in the power receiving end. In general, both sides of the coil are capable of transmitting and receiving electromagnetic waves; hence, a magnetic material is always disposed on the non-induction side of the coil, allowing the electromagnetic energy to be aggregated on the induction side. The magnetic material close to the coil may enlarge the coil inductance, which further increases the electromagnetic induction capability. In addition, the electromagnetic energy exerted on a metal may heat the metal; this principle is similar to an induction cooker. Therefore, another function of the magnetic material is to isolate the electromagnetic energy, in order to prevent the electromagnetic energy from interfering the operations of the device behind the coil, and also prevent the electromagnetic energy from heating surrounding metals for safety.

The induction type power supply system includes a power supply terminal and a power receiving terminal, where an induction coil is included in each terminal for sending power energy and control signals. The safety issue should be considered in this system. However, a user may intentionally or unintentionally insert a metal between these induction coils when using the induction type power supply system. If an intruding metal appears during power transmission, the electromagnetic energy generated by the coil may rapidly heat the intruding metal and cause an accident such as burning or exploding. Therefore, the industry pays much attention to this safety issue, and related products should possess the capability of detecting whether an intruding metal exists. When there exists an intruding metal, power supply output should be cut off for protection.

The prior art (U.S. Publication No. 2011/0196544 A1) provides a method of detecting whether an intruding metal exists between the power supply terminal and the power receiving terminal. This method has been applied to the products on sale. However, the prior art still possesses at least the following shortcomings:

First, the prior art calculates a power loss by measuring an output power of the power supply terminal and an input power of the power receiving terminal, and determines existence of the intruding metal based on the calculated power loss and a predetermined threshold value. If the power loss exceeds the threshold value, an intruding metal is determined to exist. The maximum problem of the method is in the configuration of the threshold value. If the threshold limit is too strict, the system may wrongly determine that there is an intruding metal under a normal operation; if the threshold limit is too loose, the protection may not be triggered when some types of intruding metals exist. For example, when a smaller intruding metal such as a coin, key or paper clip exists in the power transmission region of the power supply terminal, there may not appear an evident power loss but the intruding metal may still be heated significantly. Further, the configuration of the threshold value should be determined by performing data analysis based on a large number of physical samples; this consumes a lot of time and efforts.

Second, in the induction type power supply system, the factors affecting the power transmission loss between the power supply terminal and the power receiving terminal are very complex. The power loss may be affected by various events such as functionalities of circuit elements, matching of the coil and the magnetic material, relative distance and horizontal location offsets of the coils in both terminals, and media characteristics between the coils, e.g., metal paints on the coils. Since there are numerous affecting factors, the power losses of the products due to element offsets are different. Therefore, the threshold value cannot be too severe, which results in a limited protection effect.

Third, in the industry associated with the induction type power supply system, the power supply terminal and power receiving terminal of an induction type power supply system may be manufactured by different manufacturers and/or in different periods based on commercial circulation. The configuration of the above threshold value is usually implemented in the power supply terminal, but the related power setting should be adjusted for various types of power receiving circuits. It is hard to fully consider the characteristics of every type of power receiving circuits, such that compatibility problems are unavoidable.

Fourth, a circuit for implementing power measurements should be disposed in each of the power supply terminal and power receiving terminal, and the related circuit cost is necessary. In order to perform power measurements with high accuracy, the implementation requires a more complex circuit and thus requires a higher cost. The difficulty of the implementation is also higher.

Fifth, different power settings may possess different power losses. For example, an induction type power supply system has an output power equal to 5 watts (W). Assuming that its basic power loss substantially ranges from 0.5 W to 1 W, the power loss generated by the intruding metal may not be detected if the power loss is within 1 W. If the output power is increased to 50 W, the basic power loss will significantly increase to a range between 5 W and 10 W with the same circuit design. The power threshold for determining the intruding metal should also be increased with the same ratio. In such a condition, many types of intruding metals may not be detected. For example, the power loss generated by a paper clip is quite small, and is easily ignored by the conventional intruding metal detection method, while the electromagnetic induction energy received by the paper clip is still large enough to generate high temperature and cause an accident. In other words, the conventional intruding metal detection method is not feasible when the induction type power supply system is supplying power, especially when the supplied power is high.

Thus, there is a need to provide another method of detecting the intruding metal, in order to improve the protection effects on the induction type power supply system.

SUMMARY OF THE INVENTION

It is therefore an objective of the present invention to provide a method of detecting whether an intruding metal exists in the power transmission region of an induction type power supply system and the induction type power supply system using the same, in order to realize more effective intruding metal detection and further enhance the protection effects on the induction type power supply system.

The present invention discloses a method used for an induction type power supply system, for detecting whether an intruding metal exists in a power transmission region of the induction type power supply system. The method comprises interrupting at least one driving signal of the induction type power supply system to stop driving a supplying-end coil of the induction type power supply system; detecting an attenuation status of a coil signal on the supplying-end coil when driving of the supplying-end coil is interrupted; and determining whether the intruding metal exists in the power transmission region of the induction type power supply system according to the attenuation status of the coil signal.

The present invention further discloses an induction type power supply system. The induction type power supply system comprises a supplying-end module. The supplying-end module comprises a supplying-end coil, a resonant capacitor, at least one power driver unit and a supplying-end processor. The resonant capacitor, coupled to the supplying-end coil, is used for performing resonance together with the supplying-end coil. The at least one power driver unit, coupled to the supplying-end coil and the resonant capacitor, is used for sending at least one driving signal to the supplying-end coil, in order to drive the supplying-end coil to generate power. The supplying-end processor is used for receiving a coil signal on the supplying-end coil and executing the following steps: controlling the at least one power driver unit to interrupt the at least one driving signal, to stop driving the supplying-end coil; detecting an attenuation status of the coil signal when driving of the supplying-end coil is interrupted; and determining whether the intruding metal exists in the power transmission region of the induction type power supply system according to the attenuation status of the coil signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
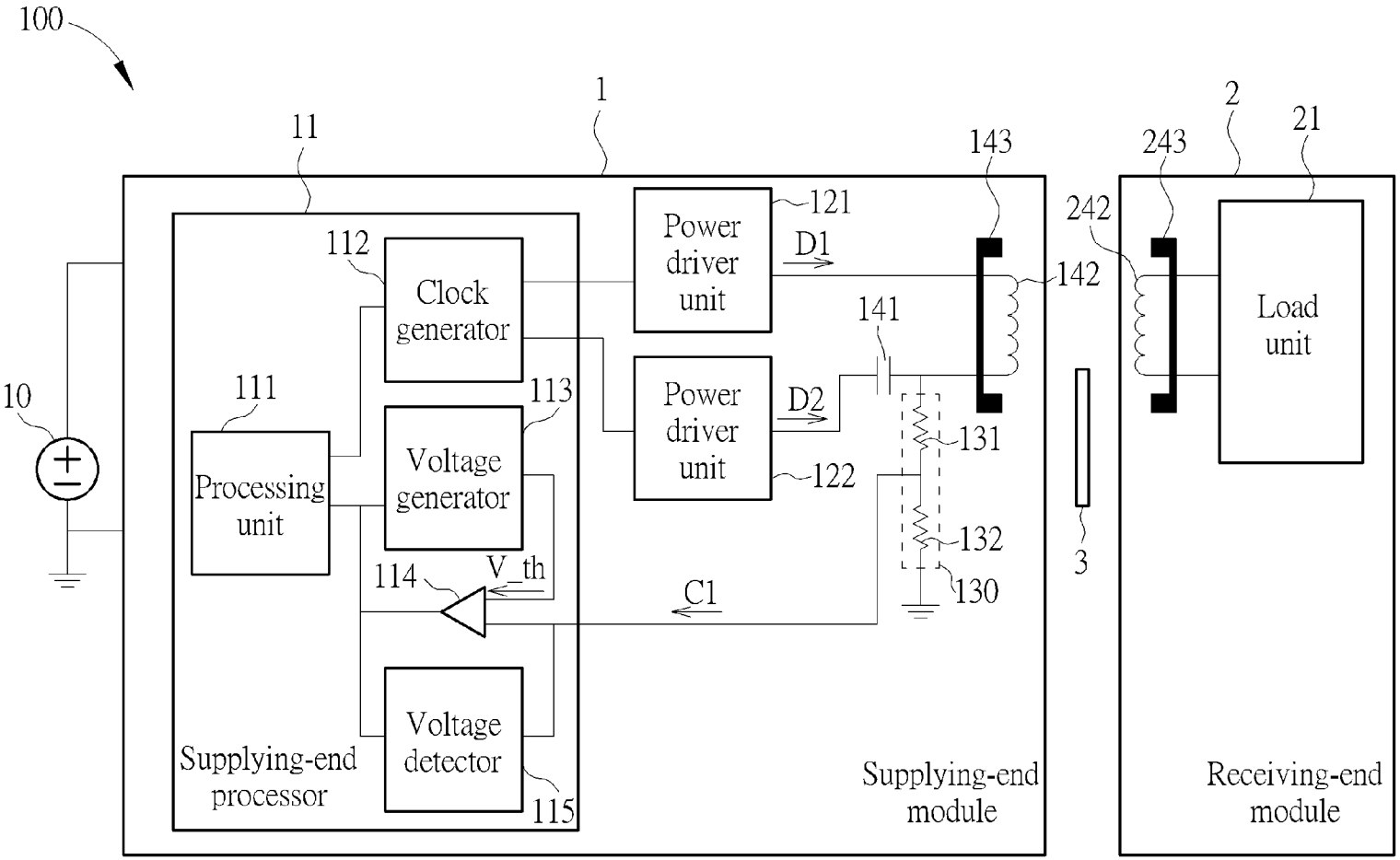
FIG. 1 is a schematic diagram of an induction type power supply system according to an embodiment of the present invention.

Please refer to FIG. 1, which is a schematic diagram of an induction type power supply system 100 according to an embodiment of the present invention. As shown in FIG. 1, the induction type power supply system 100 includes a supplying-end module 1 and a receiving-end module 2. The supplying-end module 1 receives power from a power supply device 10. The supplying-end module 1 includes a supplying-end coil 142 and a resonant capacitor 141. The supplying-end coil 142 is used for delivering electromagnetic energies to the receiving-end module 2 to supply power. The resonant capacitor 141, coupled to the supplying-end coil 142, is used for performing resonance together with the supplying-end coil 142. In addition, in the supplying-end module 1, a magnetic conductor 143 composed of magnetic materials may be selectively disposed, to enhance the electromagnetic induction capability of the supplying-end coil 142 and also prevent electromagnetic energies from affecting the back-end circuits. The supplying-end module 1 further includes power driver units 121 and 122, a supplying-end processor 11 and a voltage dividing circuit 130. The power driver units 121 and 122, coupled to the supplying-end coil 142 and the resonant capacitor 141, are used for sending driving signals D1 and D2 to the supplying-end coil 142, respectively. The power driver units 121 and 122 may be controlled by a supplying-end processor 11, for driving the supplying-end coil 142 to generate and send power. When the power driver units 121 and 122 are both active, full-bridge driving is performed. In one embodiment, only one of the power driver units 121 and 122 is active, or only one of the power driver units 121 or 122 is disposed, which leads to half-bridge driving. The supplying-end processor 11 may receive a coil signal C1 (i.e., the voltage signal between the supplying-end coil 142 and the resonant capacitor 141) from the supplying-end coil 142, and determine whether an intruding metal 3 exists in the power transmission region of the induction type power supply system 100 according to the coil signal C1. The voltage dividing circuit 130, which includes voltage dividing resistors 131 and 132, may attenuate the coil signal C1 on the supplying-end coil 142 and then output the coil signal C1 to the supplying-end processor 11. In some embodiments, if the tolerance voltage of the supplying-end processor 11 is high enough, the voltage dividing circuit 130 may not be applied and the supplying-end processor 11 may directly receive the coil signal C1 from the supplying-end coil 142. Other possible components or modules such as a signal analysis circuit, power supply unit and display unit may be included or not according to system requirements. These components are omitted without affecting the illustrations of the present embodiments.

Please keep referring to FIG. 1. The receiving-end module 2 includes a receiving-end coil 242, which is used for receiving power from the supplying-end coil 142. In the receiving-end module 2, a magnetic conductor 243 composed of magnetic materials may also be selectively disposed, to enhance the electromagnetic induction capability of the receiving-end coil 242 and also prevent electromagnetic energies from affecting the back-end circuits. The receiving-end coil 242 may send the received power to a load unit 21 in the back end. Other possible components or modules in the receiving-end module 2 such as a regulator circuit, resonant capacitor, rectification circuit, signal feedback circuit, and receiving-end processor may be included or not according to system requirements. These components are omitted without affecting the illustrations of the present embodiments.

Figure 2:
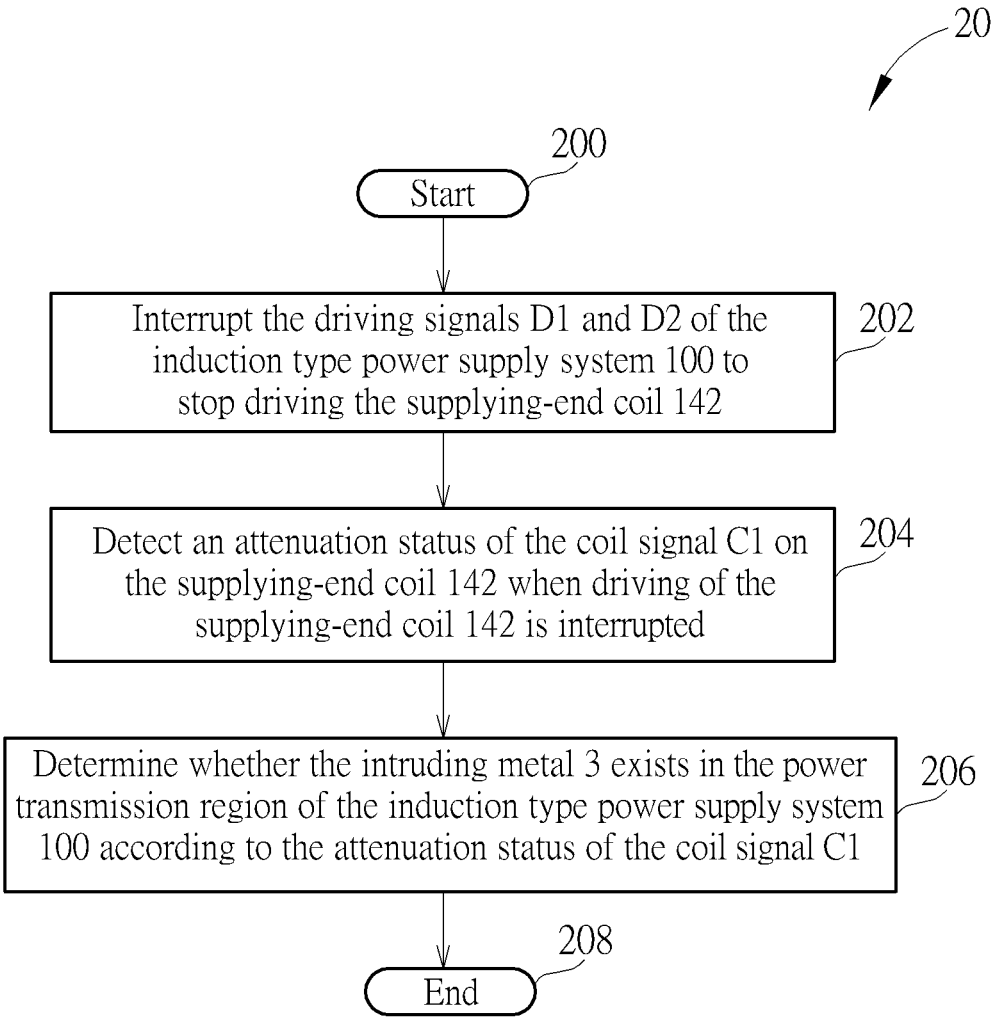
FIG. 2 is a schematic diagram of an intruding metal determination process according to an embodiment of the present invention.

Different from the prior art where both of the power supply terminal and power receiving terminal have to perform power measurement to determine the intruding metal via power loss detection, the present invention may determine whether there exists an intruding metal in the power transmission region of the supplying-end coil by interpreting the coil signal in the power supply terminal only. Please refer to FIG. 2, which is a schematic diagram of an intruding metal determination process 20 according to an embodiment of the present invention. As shown in FIG. 2, the intruding metal determination process 20 is used for a power supply terminal of an induction type power supply system (e.g., the supplying-end module 1 of the induction type power supply system 100 shown in FIG. 1) and includes the following steps:

Step 200: Start.

Step 202: Interrupt the driving signals D1 and D2 of the induction type power supply system 100 to stop driving the supplying-end coil 142.

Step 204: Detect an attenuation status of the coil signal C1 on the supplying-end coil 142 when driving of the supplying-end coil 142 is interrupted.

Step 206: Determine whether the intruding metal 3 exists in the power transmission region of the induction type power supply system 100 according to the attenuation status of the coil signal C1.

Step 208: End.

Figure 3:
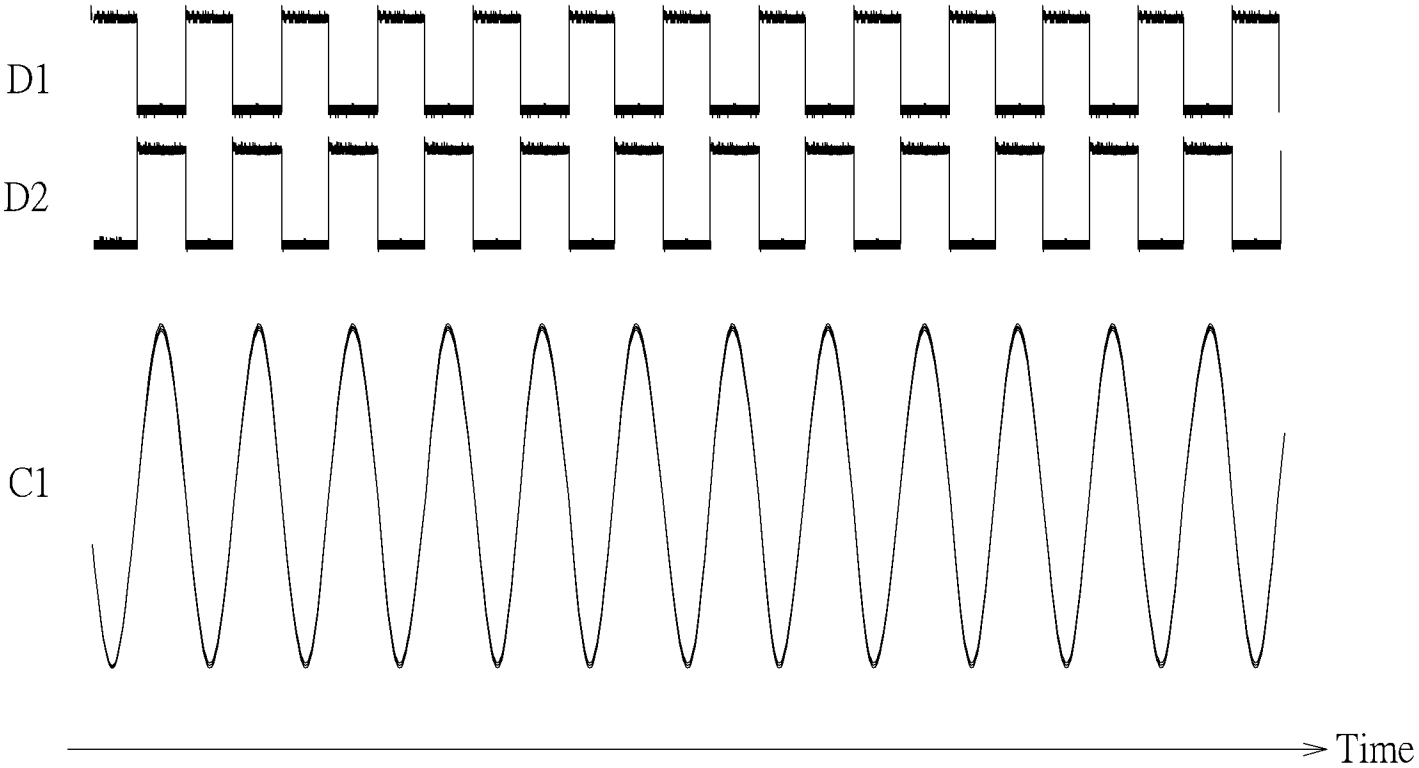
FIG. 3 is a waveform diagram of driving signals which drive the supplying-end coil to let the coil signal to oscillate stably.
Figure 4:
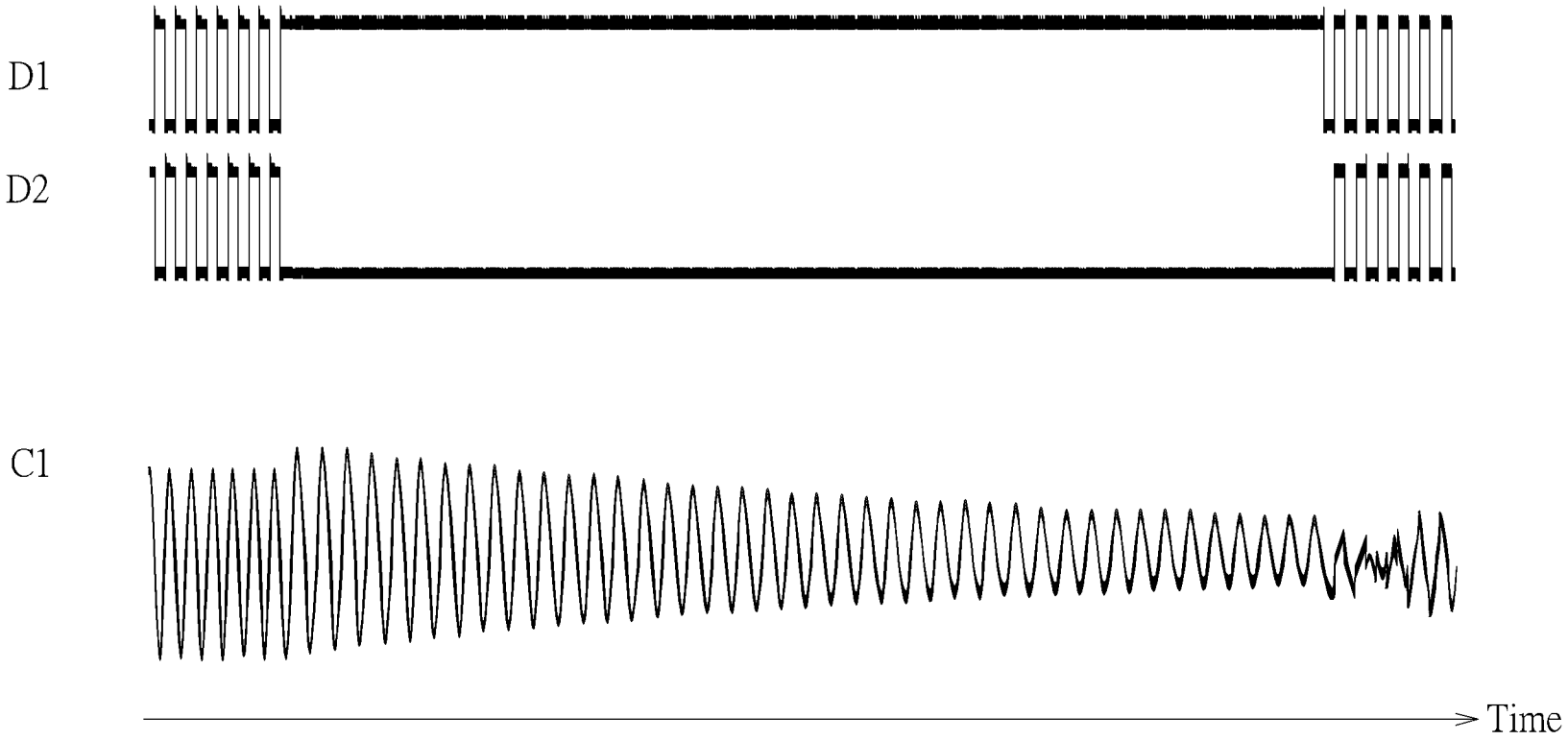
FIG. 4 is a waveform diagram of attenuating oscillation of the coil signal when the driving signals are interrupted.

According to the intruding metal determination process 20, in the supplying-end module 1 of the induction type power supply system 100, the driving signals D1 and D2 may be interrupted for a while during the driving process. At this moment, the power driver units 121 and 122 may stop driving the supplying-end coil 142 (Step 202). In general, when the supplying-end coil 142 is driven normally, the driving signals D1 and D2 outputted by the power driver units 121 and 122 are two rectangular waves opposite to each other. In such a situation, the coil signal C1 on the supplying-end coil 142 may appear to oscillate stably, as shown in FIG. 3. When the driving of the supplying-end coil 142 is interrupted, the coil signal C1 may keep oscillating and attenuate gradually due to energies remaining between the supplying-end coil and the resonant capacitor. FIG. 4 illustrates a situation of attenuating oscillation of the coil signal C1. When the driving signals D1 and D2 are interrupted, the driving signals D1 and D2, which are rectangular waves originally, stay in a higher voltage level and a lower voltage level, respectively, and stop driving the supplying-end coil 142. At this moment, the coil signal C1 may start to attenuate and keep oscillating. Subsequently, the supplying-end processor 11 detects the attenuation status of the coil signal C1 (Step 204), and determines whether the intruding metal 3 exists in the power transmission region of the induction type power supply system 100 according to the attenuation status of the coil signal C1 (Step 206). More specifically, the supplying-end processor 11 may determine whether the intruding metal 3 exists in the power transmission region of the induction type power supply system 100 according to the attenuation speed of the coil signal C1.

Figure 5A:
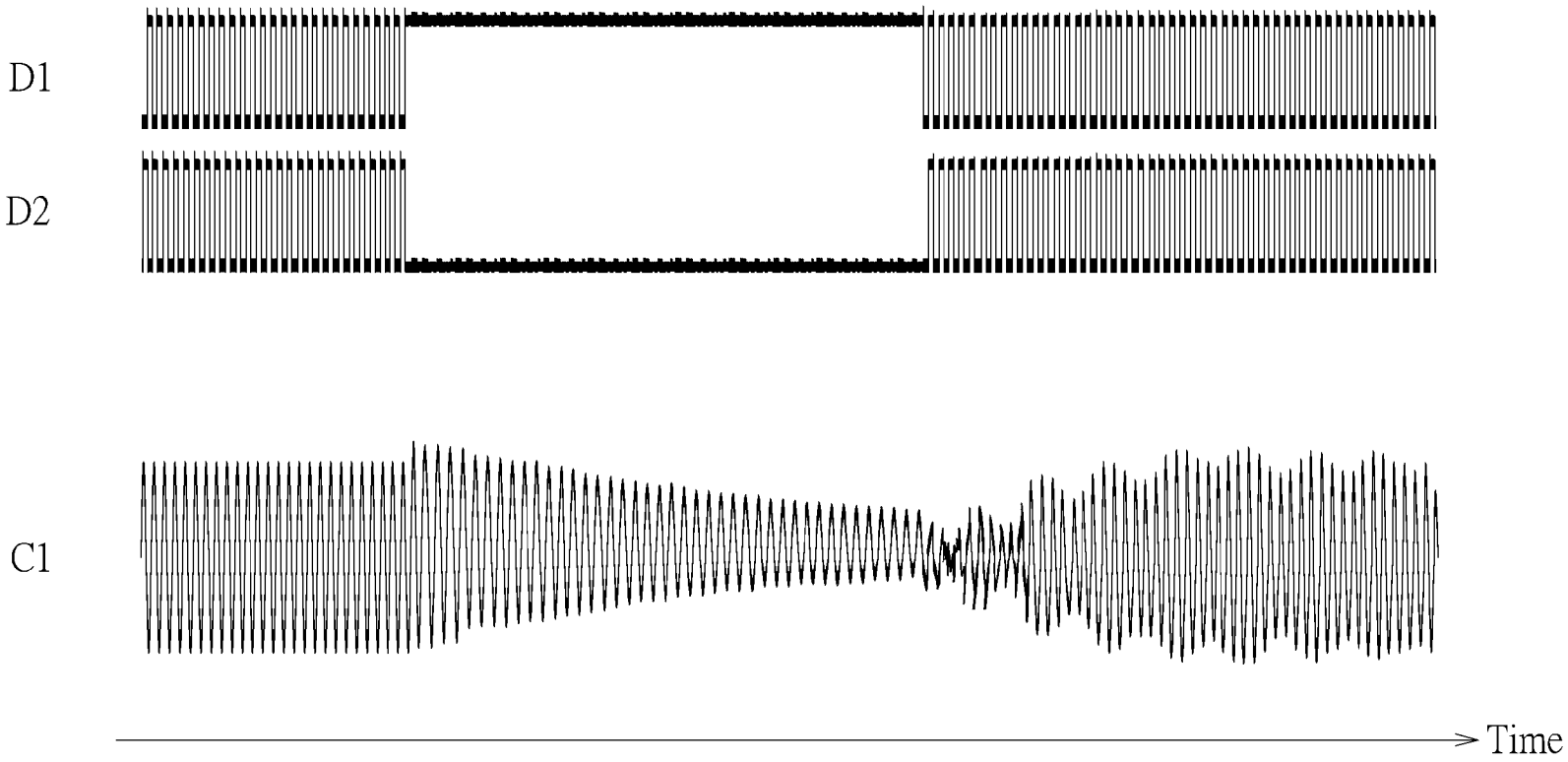
FIG. 5A is a waveform diagram of normal attenuation of the coil signal when the driving signals are interrupted where there is no intruding metal.
Figure 5B:
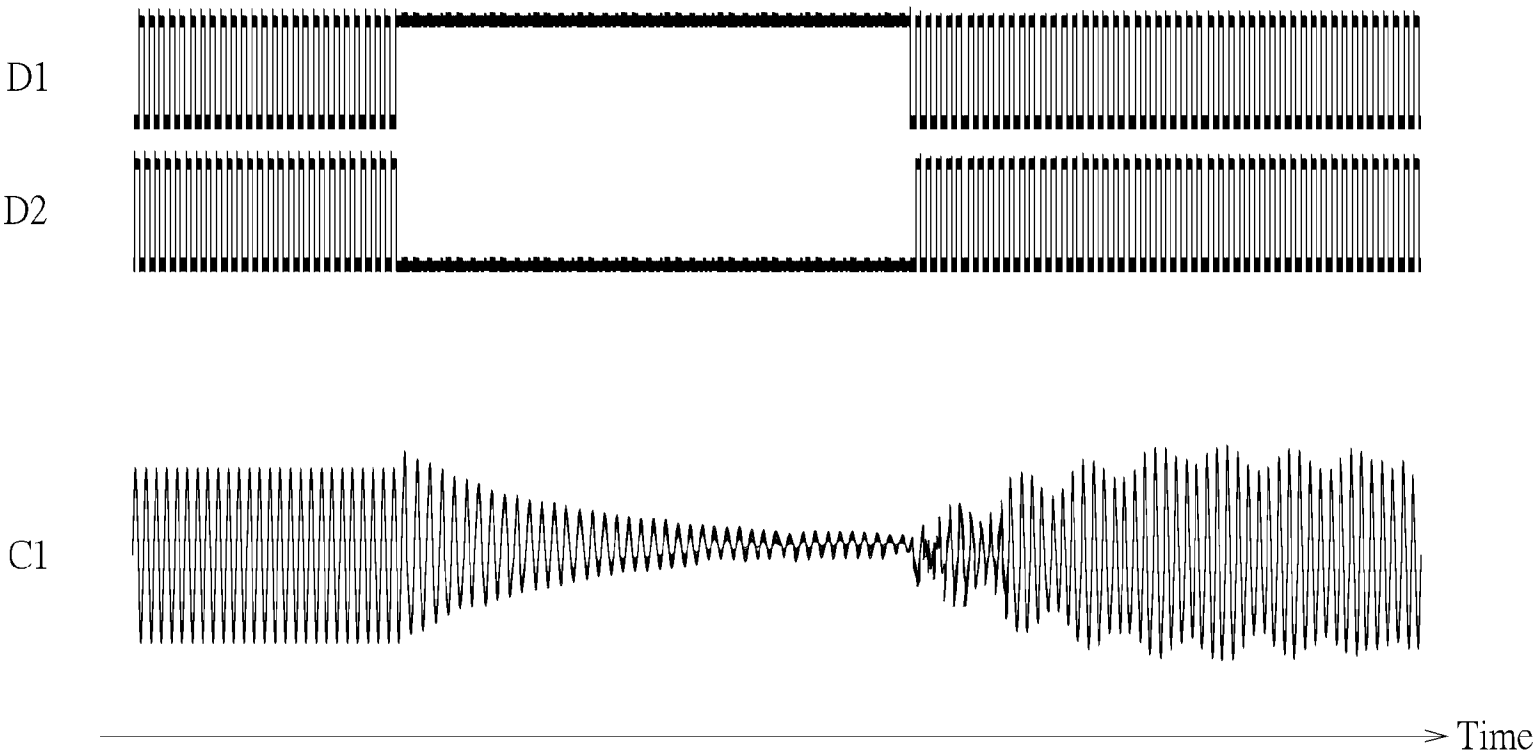
FIG. 5B and FIG. 5C are waveform diagrams of attenuation of the coil signal when the driving signals are interrupted where an intruding metal exists.
Figure 5C:
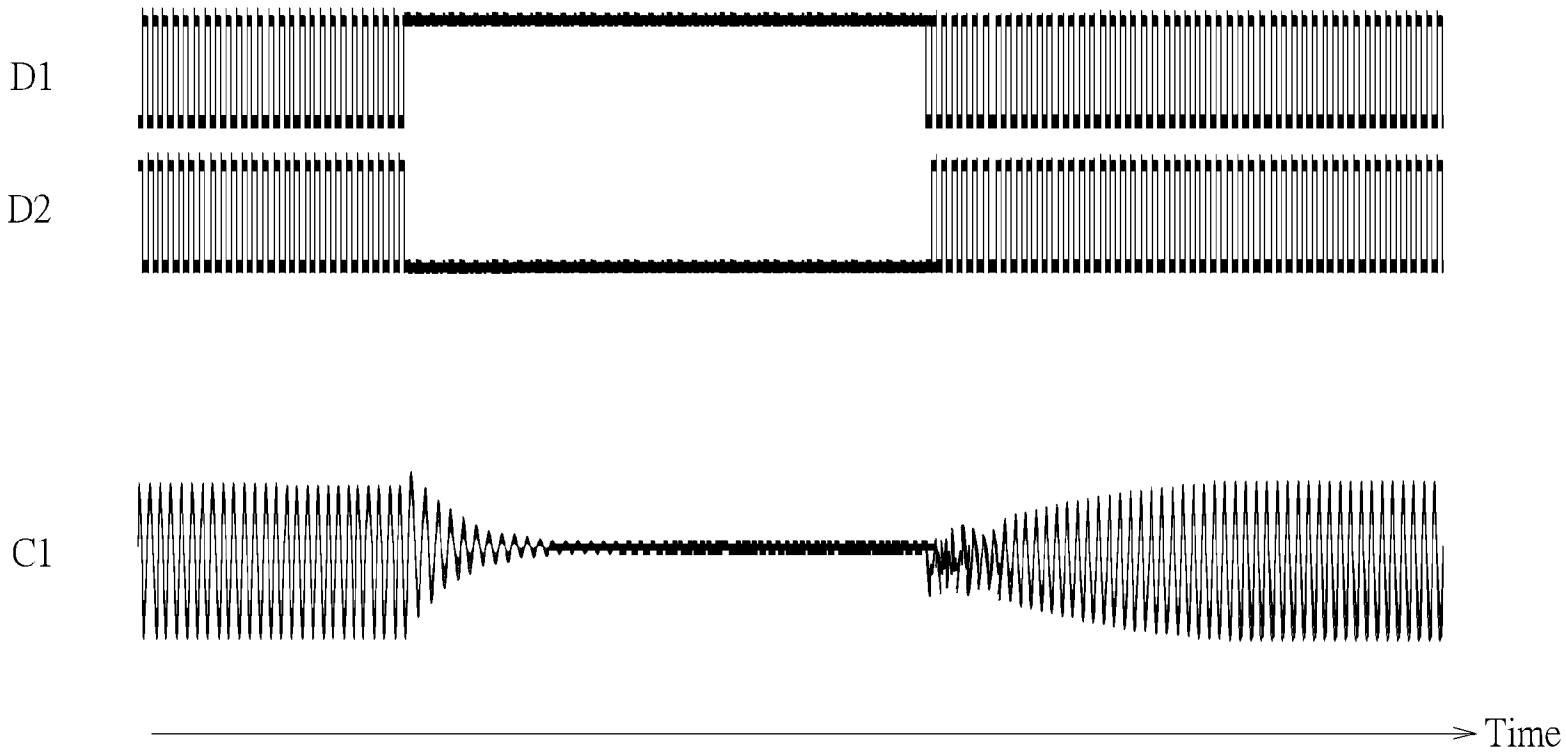

Please refer to FIG. 5A, FIG. 5B and FIG. 5C. FIG. 5A is a waveform diagram of normal attenuation of the coil signal C1 when the driving signals D1 and D2 are interrupted where there is no intruding metal. FIG. 5B and FIG. 5C are waveform diagrams of attenuation of the coil signal C1 when the driving signals D1 and D2 are interrupted where an intruding metal exists. The waveforms shown in FIGS. 5A-5C will be compared as follows. In FIG. 5A, the coil signal C1 may attenuate slowly if there is no intruding metal until the driving signals D1 and D2 are restarted, where the attenuation speed depends on the damping coefficient of the coil. As shown in FIG. 5B, the attenuation speed of the coil signal C1 may significantly increase when an intruding metal exists. That is, the intruding metal may significantly increase the damping coefficient of attenuation of the coil signal C1 while absorbing the energy sent by the supplying-end coil 142, such that the oscillation amplitude of the coil signal C1 shrinks rapidly. FIG. 5C illustrates a condition where the intruding metal is larger, which results in more rapid attenuation on the coil signal C1. According to the above characteristics, a threshold value may be configured by the supplying-end processor 11 for determining the attenuation speed of the coil signal C1. For example, when the attenuation speed of the coil signal C1 is greater than the threshold value, the supplying-end processor 11 may determine that there is an intruding metal existing in the power transmission region of the induction type power supply system 100, and thereby perform power cut or other protective actions.

Figure 6:
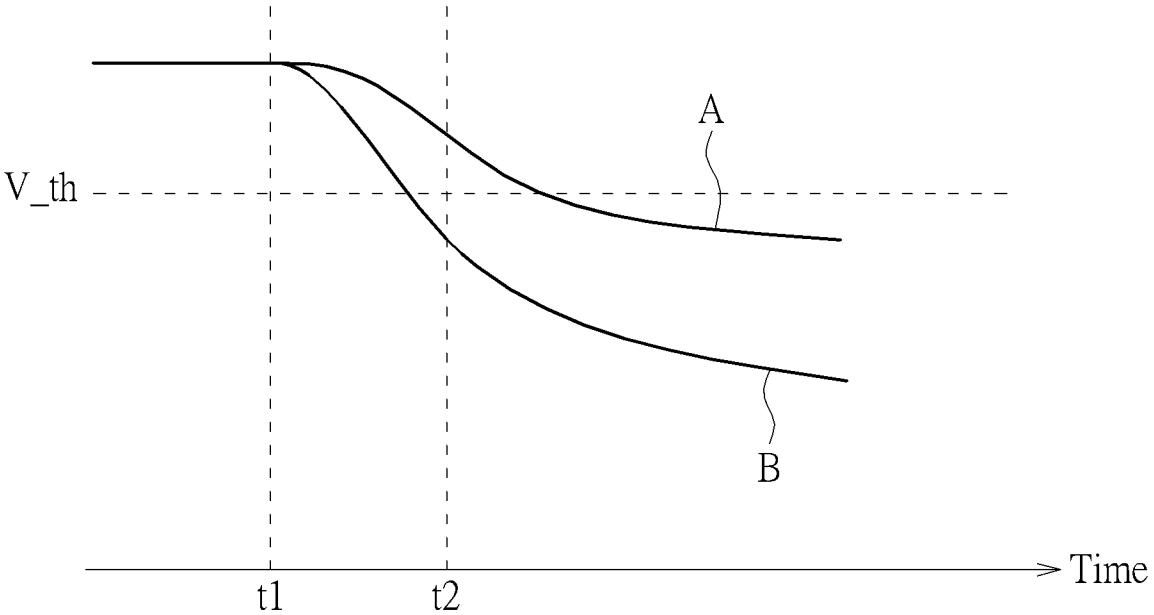
FIG. 6 is a schematic diagram of using a threshold voltage for determining the attenuation speed of the coil signal according to an embodiment of the present invention.

The above method of determining the attenuation speed of the coil signal C1 may be realized via configuration of a threshold voltage. Please refer to FIG. 6, which is a schematic diagram of using a threshold voltage for determining the attenuation speed of the coil signal C1 according to an embodiment of the present invention. As shown in FIG. 6, a waveform A illustrates a normal attenuation of the coil signal C1 peaks when there is no intruding metal, and a waveform B illustrates an attenuation of the coil signal C1 peaks when an intruding metal exists. The coil signal C1 starts to attenuate at a time point t1. The supplying-end processor 11 may configure a threshold voltage V_th smaller than the maximum voltage of the coil signal C1. If the peak value of the coil signal C1 attenuates to the threshold voltage V_th after a time point t2, the attenuation speed is slower and the supplying-end processor 11 may determine that there is no intruding metal. If the peak value of the coil signal C1 attenuates to the threshold voltage V_th before the time point t2, the attenuation speed is faster and the supplying-end processor 11 may determine that there exists an intruding metal.

Please keep referring to FIG. 6 together with FIG. 1. The supplying-end processor 11 includes a processing unit 111, a clock generator 112, a voltage generator 113, a comparator 114 and a voltage detector 115. The clock generator 112, coupled to the power driver units 121 and 122, is used for controlling the power driver units 121 and 122 to send the driving signals D1 and D2 or interrupt the driving signals D1 and D2. The clock generator 112 may be a pulse width modulation (PWM) generator or other type of clock generator, which outputs a clock signal to the power driver units 121 and 122. The voltage detector 115 is used for detecting a peak voltage of the coil signal C1 and sending the detected voltage information to the processing unit 111. The voltage detector 115 may be an analog to digital converter (ADC), which converts an analog voltage on the supplying-end coil 142 into digital voltage information and outputs the voltage information to the processing unit 111. The processing unit 111, coupled to the voltage detector 115, then configures the threshold voltage V_th according to the peak voltage information, and outputs the information of the threshold voltage V_th to the voltage generator 113. Therefore, the threshold voltage V_th may be used for determining whether an intruding metal 3 exists in the power transmission region of the induction type power supply system 100. The voltage generator 113 is used for outputting the threshold voltage V_th. The voltage generator 113 may be a digital to analog converter (DAC), which receives the threshold voltage information from the processing unit 111 and converts the information into an analog voltage to be outputted. An input terminal of the comparator 114 may receive the threshold voltage V_th, and another input terminal of the comparator 114 may receive the coil signal C1 from the supplying-end coil 142, so that the comparator 114 may compare the coil signal C1 with the threshold voltage V_th to generate a comparison result. The processing unit 111 then determines the attenuation speed of the coil signal C1 according to the comparison result, in order to determine whether there is an intruding metal existing in the power transmission region of the induction type power supply system 100. In other words, the present invention may determine whether an intruding metal exists in the power transmission region of the induction type power supply system 100 by obtaining the duration time of the peak voltage of the coil signal C1 attenuating to the threshold voltage V_th.

Figure 7:
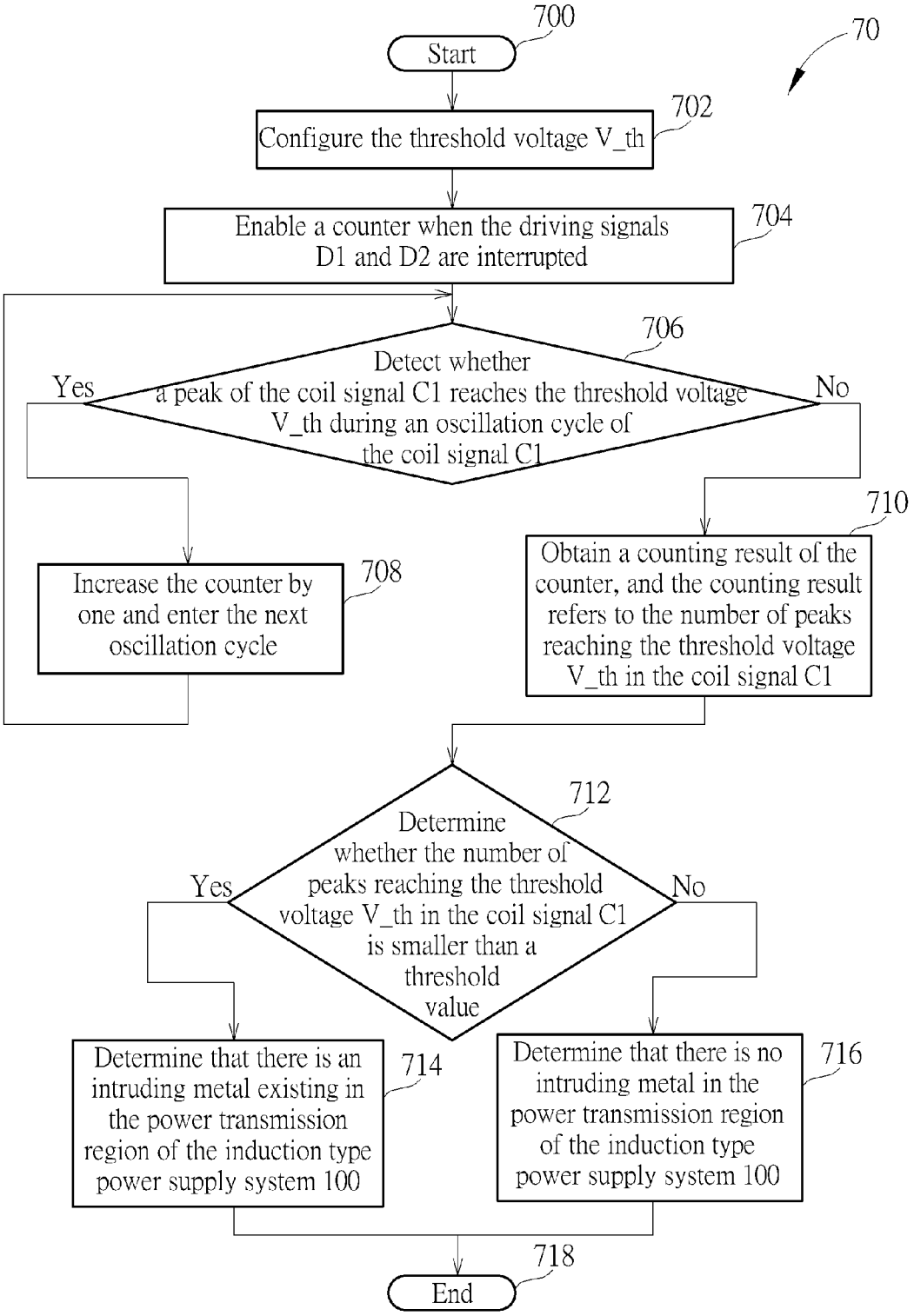
FIG. 7 is a schematic diagram of a detailed process of intruding metal determination according to an embodiment of the present invention.

In an embodiment, the supplying-end processor 11 may determine the attenuation speed of the coil signal C1 according to the number of peaks reaching the threshold voltage V_th in the coil signal C1 after the driving signals D1 and D2 are interrupted. Please refer to FIG. 7, which is a schematic diagram of a detailed process 70 of intruding metal determination according to an embodiment of the present invention. As shown in FIG. 7, the detailed process 70, which may be realized by the supplying-end processor 11 to determine the attenuation speed of the coil signal C1 via the number of peaks reaching the threshold voltage V_th, includes the following steps:

Step 700: Start.

Step 702: Configure the threshold voltage V_th.

Step 704: Enable a counter when the driving signals D1 and D2 are interrupted.

Step 706: Detect whether a peak of the coil signal C1 reaches the threshold voltage V_th during an oscillation cycle of the coil signal C1. If yes, go to Step 708; otherwise, go to Step 710.

Step 708: Increase the counter by one and enter the next oscillation cycle. Then go to Step 706.

Step 710: Obtain a counting result of the counter, and the counting result refers to the number of peaks reaching the threshold voltage V_th in the coil signal C1.

Step 712: Determine whether the number of peaks reaching the threshold voltage V_th in the coil signal C1 is smaller than a threshold value. If yes, go to Step 714; otherwise, go to Step 716.

Step 714: Determine that there is an intruding metal existing in the power transmission region of the induction type power supply system 100.

Step 716: Determine that there is no intruding metal in the power transmission region of the induction type power supply system 100.

Step 718: End.

According to the detailed process 70 of intruding metal determination, the supplying-end processor 11 may configure the value of the threshold voltage V_th. For example, the processing unit 111 of the supplying-end processor 11 may configure the value of the threshold voltage V_th according to the voltage information from the voltage detector 115. Subsequently, when the driving signals D1 and D2 are interrupted, the supplying-end processor 11 may enable a counter and start to detect the peak values of the coil signal C1. The supplying-end processor 11 may detect the peak value of the coil signal C1 during each oscillation cycle of the coil signal C1. When the peak value still exceeds the threshold voltage V_th, the supplying-end processor 11 will detect the magnitude of the peak value in the next oscillation cycle and increase the counter by one. With the peak attenuation of the coil signal C1, the peak value may gradually fall to the threshold voltage V_th. Until a peak smaller than the threshold voltage V_th occurs, the supplying-end processor 11 may obtain the counting result of the counter. This counting result refers to the number of peaks reaching the threshold voltage V_th in the coil signal C1.

In such a situation, the supplying-end processor 11 may determine the attenuation speed of the coil signal C1 via the number of peaks reaching the threshold voltage V_th in the coil signal C1. The more the number of peaks reaching the threshold voltage V_th in the coil signal C1, the slower the attenuation speed of the coil signal C1, which means that the intruding metal may not exist. The fewer the number of peaks reaching the threshold voltage V_th in the coil signal C1, the faster the attenuation speed of the coil signal C1, which means that there may be an intruding metal existing in the power transmission region of the induction type power supply system 100. The supplying-end processor 11 may configure a threshold value. If the number of peaks reaching the threshold voltage V_th in the coil signal C1 is smaller than the threshold value, the supplying-end processor 11 may determine that there is an intruding metal in the power transmission region of the induction type power supply system 100, and thereby perform power cut or other protective actions. In contrast, if the number of peaks reaching the threshold voltage V_th in the coil signal C1 is greater than the threshold value, the supplying-end processor 11 may determine that there is no intruding metal in the power transmission region of the induction type power supply system 100.

Figure 8:
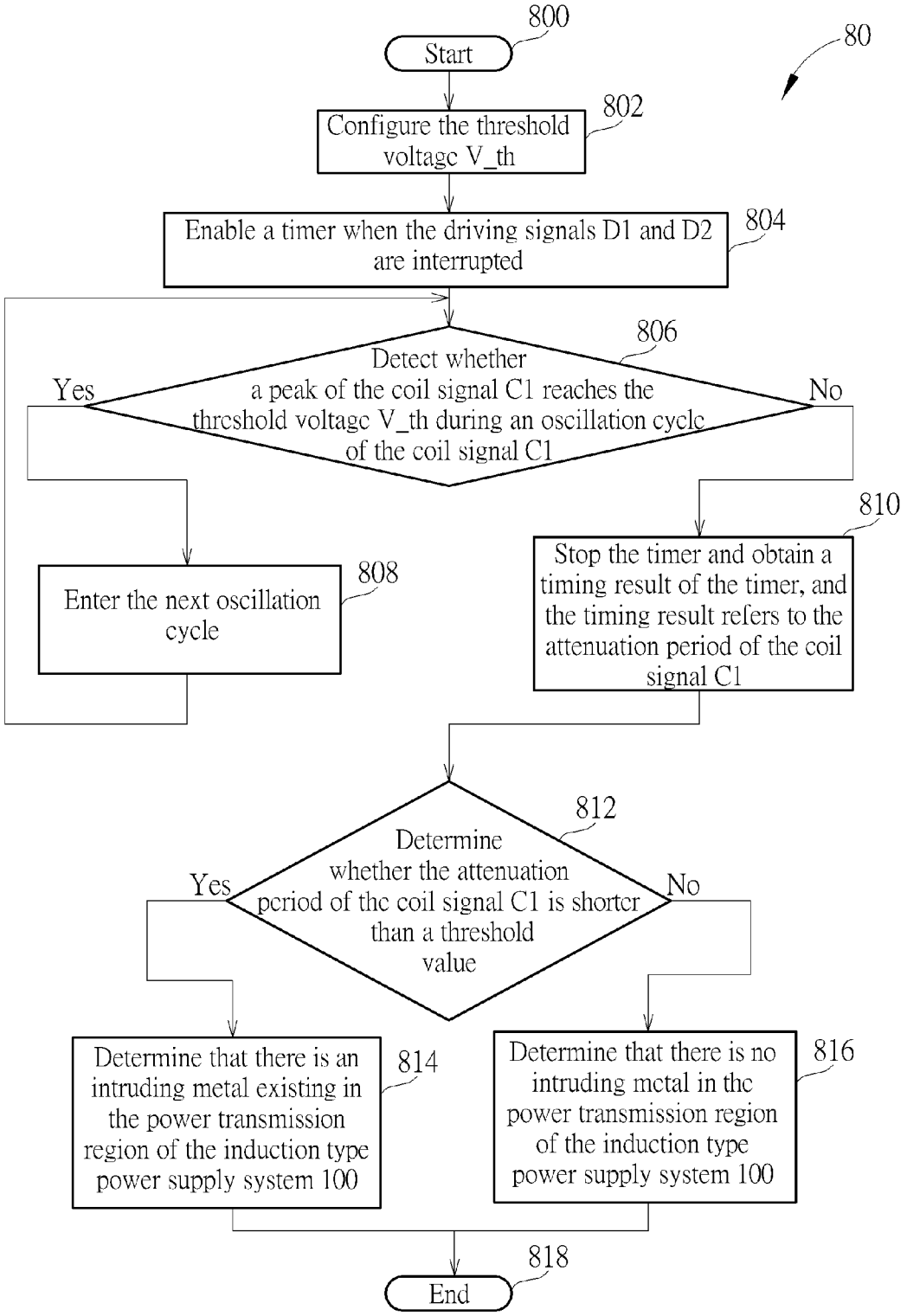
FIG. 8 is a schematic diagram of another detailed process of intruding metal determination according to an embodiment of the present invention.

In another embodiment, the supplying-end processor 11 may determine the attenuation speed of the coil signal C1 according to an attenuation period of the coil signal C1 after the driving signals D1 and D2 are interrupted. Please refer to FIG. 8, which is a schematic diagram of another detailed process 80 of intruding metal determination according to an embodiment of the present invention. As shown in FIG. 8, the detailed process 80, which may be realized by the supplying-end processor 11 to determine the attenuation speed of the coil signal C1 via the attenuation period of the coil signal C1, includes the following steps:

Step 800: Start.

Step 802: Configure the threshold voltage V_th.

Step 804: Enable a timer when the driving signals D1 and D2 are interrupted.

Step 806: Detect whether a peak of the coil signal C1 reaches the threshold voltage V_th during an oscillation cycle of the coil signal C1. If yes, go to Step 808; otherwise, go to Step 810.

Step 808: Enter the next oscillation cycle. Then go to Step 806.

Step 810: Stop the timer and obtain a timing result of the timer, and the timing result refers to the attenuation period of the coil signal C1.

Step 812: Determine whether the attenuation period of the coil signal C1 is shorter than a threshold value. If yes, go to Step 814; otherwise, go to Step 816.

Step 814: Determine that there is an intruding metal existing in the power transmission region of the induction type power supply system 100.

Step 816: Determine that there is no intruding metal in the power transmission region of the induction type power supply system 100.

Step 818: End.

According to the detailed process 80 of intruding metal determination, the supplying-end processor 11 may configure the value of the threshold voltage V_th. Similarly, the processing unit 111 of the supplying-end processor 11 may configure the value of the threshold voltage V_th according to the voltage information from the voltage detector 115. When the driving signals D1 and D2 are interrupted, the supplying-end processor 11 may enable a timer and start to detect the peak values of the coil signal C1. The supplying-end processor 11 may detect the peak value of the coil signal C1 during each oscillation cycle of the coil signal C1. When the peak value still exceeds the threshold voltage V_th, the supplying-end processor 11 will detect the magnitude of the peak value in the next oscillation cycle. With the peak attenuation of the coil signal C1, the peak value may gradually fall to the threshold voltage V_th. Until a peak smaller than the threshold voltage V_th occurs, the supplying-end processor 11 may stop the timer and obtain the timing result of the timer. This timing result refers to the attenuation period of the coil signal C1 attenuating to the threshold voltage V_th. In other words, the attenuation period of the coil signal C1 starts when the driving signals D1 and D2 are interrupted and ends when there appears a peak of the coil signal C1 failing to reach the threshold voltage V_th.

In such a situation, the supplying-end processor 11 may determine the attenuation speed of the coil signal C1 via the attenuation period required by the peak value of the coil signal C1 to reach the threshold voltage V_th. The longer the time period for the peak value of the coil signal C1 to reach the threshold voltage V_th, the slower the attenuation speed of the coil signal C1, which means that the intruding metal may not exist. The shorter the time period for the peak value of the coil signal C1 to reach the threshold voltage V_th, the faster the attenuation speed of the coil signal C1, which means that there may be an intruding metal existing in the power transmission region of the induction type power supply system 100. The supplying-end processor 11 may configure a threshold value. If the attenuation period of the coil signal C1 is shorter than the threshold value V_th, the supplying-end processor 11 may determine that there is an intruding metal in the power transmission region of the induction type power supply system 100, and thereby perform power cut or other protective actions. In contrast, if the attenuation period of the coil signal C1 is longer than the threshold voltage V_th, the supplying-end processor 11 may determine that there is no intruding metal in the power transmission region of the induction type power supply system 100.

Figure 9A:
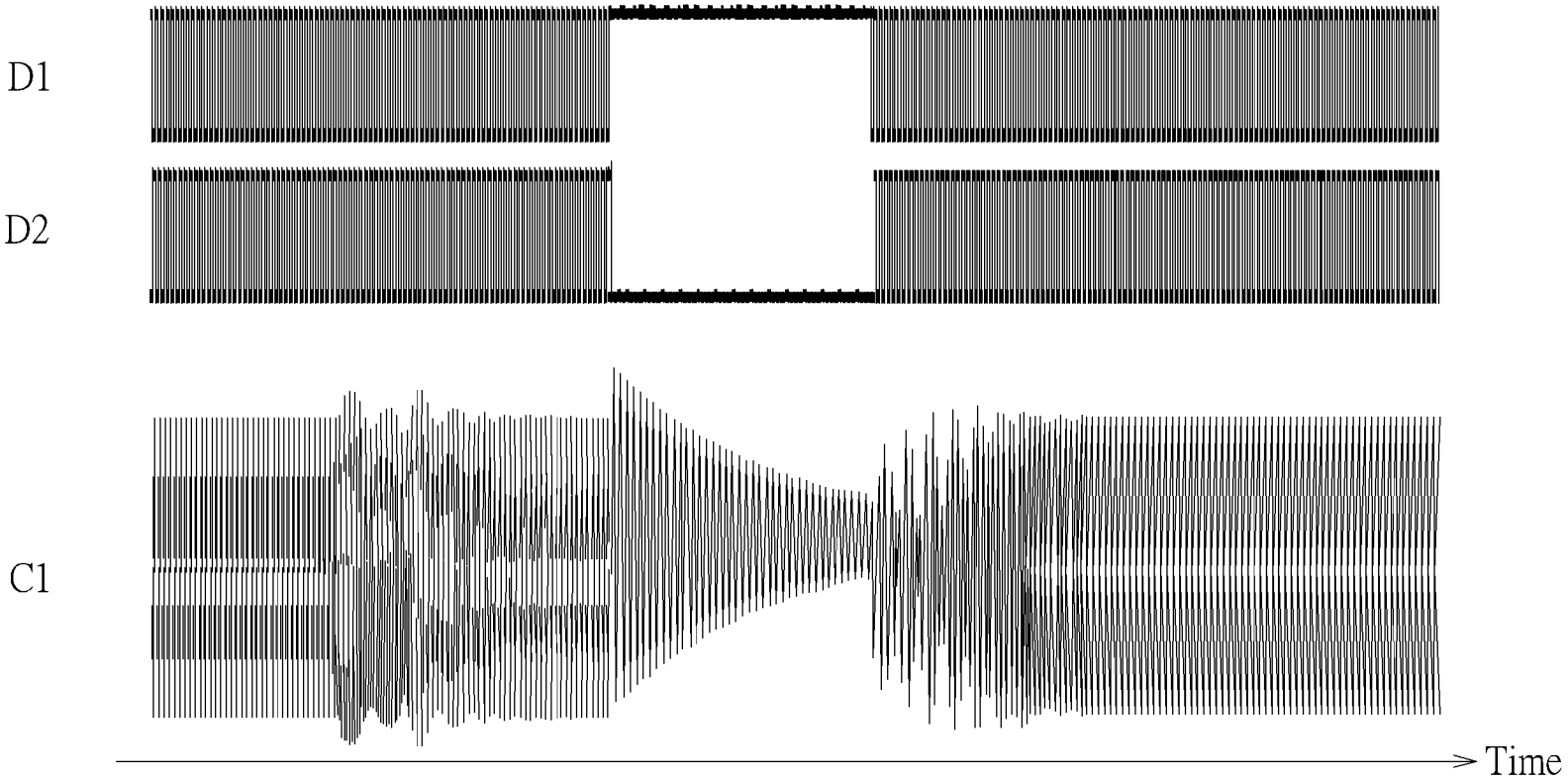
FIG. 9A is a waveform diagram of attenuation of the coil signal without any intruding metal when the driving signals are interrupted.
Figure 9B:
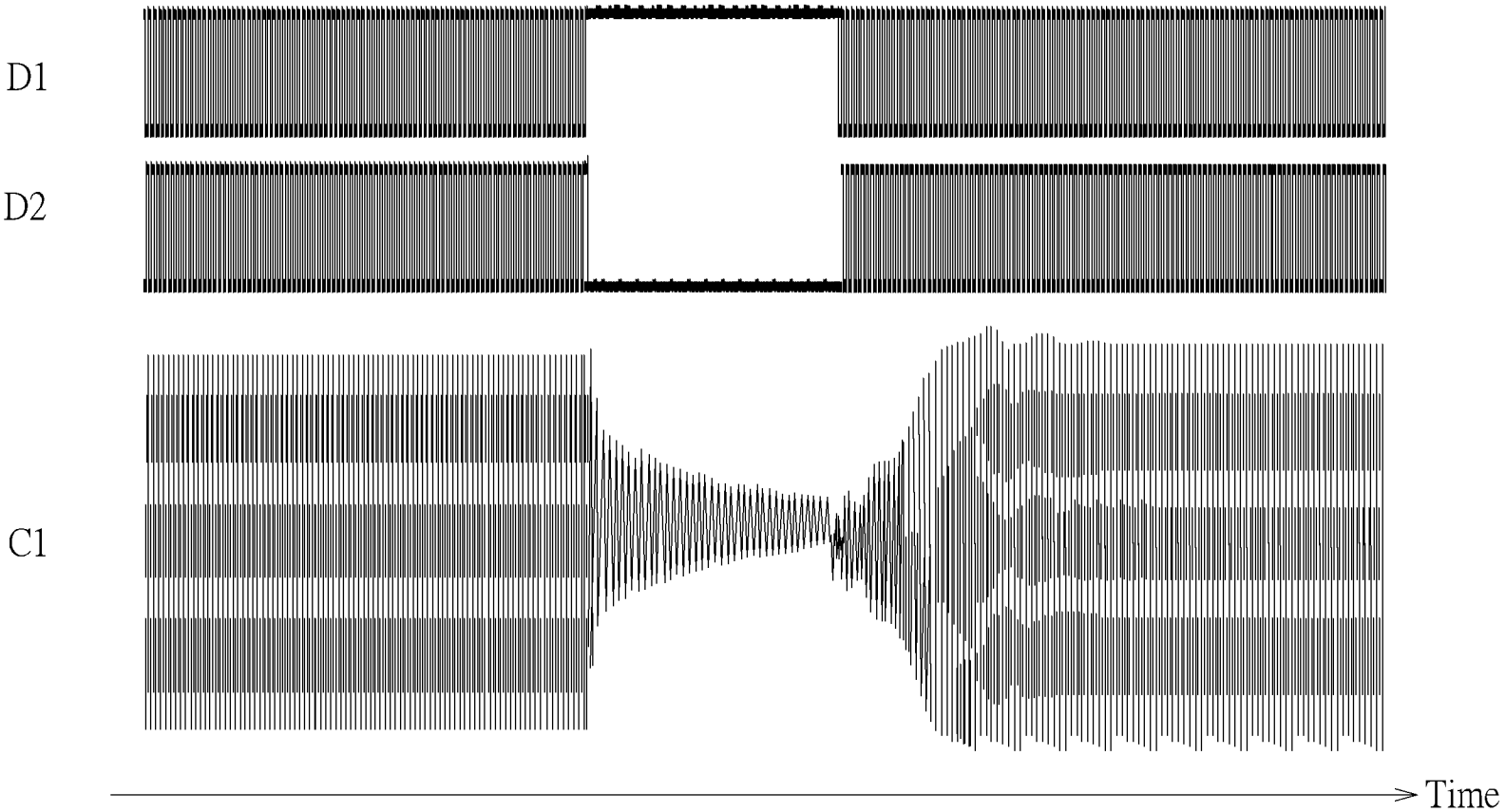
FIG. 9B is a waveform diagram of attenuation of the coil signal with an existing intruding metal when the driving signals are interrupted.

Please note that the above method of determining the intruding metal via the attenuation speed of the coil signal C1 is difficult to be affected by the load in the power receiving terminal. That is, even when the supplying-end module 1 is supplying power, the intruding metal detection can still be performed by shortly interrupting the driving signals D1 and D2. The load of the power receiving terminal may not vary the attenuation status and speed of the coil signal C1. Please refer to FIG. 9A and FIG. 9B, which illustrate the situations where the power receiving terminal has a load. As shown in the waveform of the coil signal C1, the supplying-end coil 142 receives a feedback signal from the power receiving terminal. FIG. 9A is a waveform diagram of attenuation of the coil signal C1 without any intruding metal when the driving signals D1 and D2 are interrupted. FIG. 9B is a waveform diagram of attenuation of the coil signal C1 with an existing intruding metal when the driving signals D1 and D2 are interrupted. As can be seen from FIG. 9A and FIG. 9B, even if the supplying-end module 1 is supplying power, the supplying-end processor 11 may still detect evident variation in the attenuation speed of the coil signal C1 due to an existing intruding metal when the driving signals D1 and D2 are interrupted. The attenuation speed will not be affected by whether the power supply terminal is supplying power. In addition, the attenuation speed of the coil signal C1 may not be affected even when the output power of the supplying-end coil 142 is enlarged. Please note that when the power receiving terminal has a load, the amplitude of the coil signal C1 may vary during the driving process. In such a situation, the voltage detector 115 may immediately obtain the peak voltage of the coil signal C1, so that the supplying-end processor 11 may adjust the threshold voltage V_th according to the magnitude of the peak voltage received by the voltage detector 115, in order to accurately detect the attenuation speed of the coil signal C1. More specifically, the supplying-end processor 11 may configure the threshold voltage V_th to be smaller than the peak voltage of the supplying-end coil 142 under normal driving, allowing the threshold voltage V_th to be used for the detection of signal attenuation.

Figure 10:
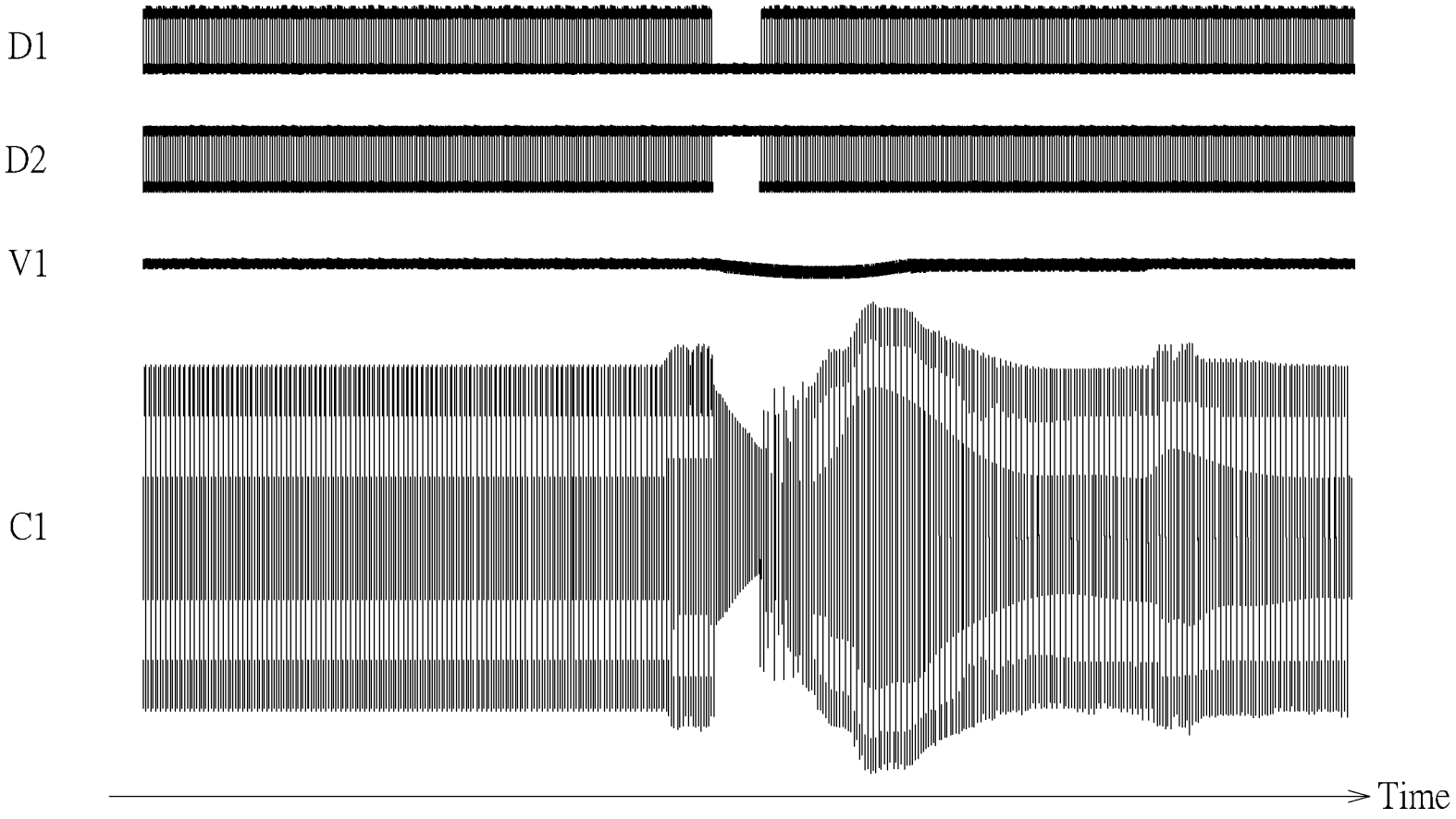
FIG. 10 is a waveform diagram of detecting the attenuation speed of the coil signal by interrupting the driving signals according to an embodiment of the present invention.

In addition, the method of detecting the attenuation speed of the coil signal C1 by interrupting the driving signals D1 and D2 only needs to perform interruption for a very short time during the power output process, and should not affect power transmission. Please refer to FIG. 10, which is a waveform diagram of detecting the attenuation speed of the coil signal C1 by interrupting the driving signals D1 and D2 according to an embodiment of the present invention. As shown in FIG. 10, V1 stands for an output voltage outputted to the load by the induction type power supply system 100. Since the power receiving terminal always possesses a large regulation capacitor, the influence on the output voltage V1 due to the short-term interruption of the driving signals D1 and D2 will be quite small.

Please note that, in addition to detecting the attenuation speed of the coil signal C1 to determine whether an intruding metal exists, the supplying-end processor 11 may further determine the type or size of the intruding metal. In an embodiment, the supplying-end processor 11 may configure a plurality of threshold voltages and obtain the attenuation pattern of the coil signal C1 according to the attenuation periods of peaks of the coil signal C1 respectively attenuating to the plurality of threshold voltages. Subsequently, the supplying-end processor 11 may determine whether an intruding metal exists in the power transmission region of the induction type power supply system 100 and also determine the type or size of the intruding metal according to the attenuation pattern of the coil signal C1. For example, when two threshold voltages V_th1 and V_th2 are configured, the supplying-end processor 11 may obtain the attenuation periods of the peaks of the coil signal C1 attenuating to the threshold voltage V_th1 (or the number of peaks exceeding the threshold voltage V_th1), and also obtain the attenuation periods of peaks of the coil signal C1 attenuating to the threshold voltage V_th2 (or the number of peaks exceeding the threshold voltage V_th2). The supplying-end processor 11 may calculate the attenuation slope of the coil signal C1 accordingly, in order to determine the size or type of the intruding metal. Different types of metals may appear to have different attenuation patterns. For example, iron or copper may result in faster attenuation, so the measured attenuation slope of the coil signal C1 is larger. In contrast, aluminum may result in a relatively slow attenuation. In addition, the intruding metal having a larger size may also generate a larger slope. According to the determination of various types of intruding metals, the system may perform appropriate protective actions according to the level of threats possibly generated by different types of intruding metals.

In this case, the supplying-end processor 11 may include two voltage generators and two comparators, wherein the two voltage generators output the threshold voltages V_th1 and V_th2, respectively, and the two comparators correspondingly compare the coil signal C1 with the threshold voltages V_th1 and V_th2, respectively. The manufacturer of the induction type power supply system 100 may dispose any number of voltage generators and comparators in the supplying-end processor 11 according to practical requirements, in order to determine the size or type of intruding metal via any number of threshold voltages.

Figure 11:
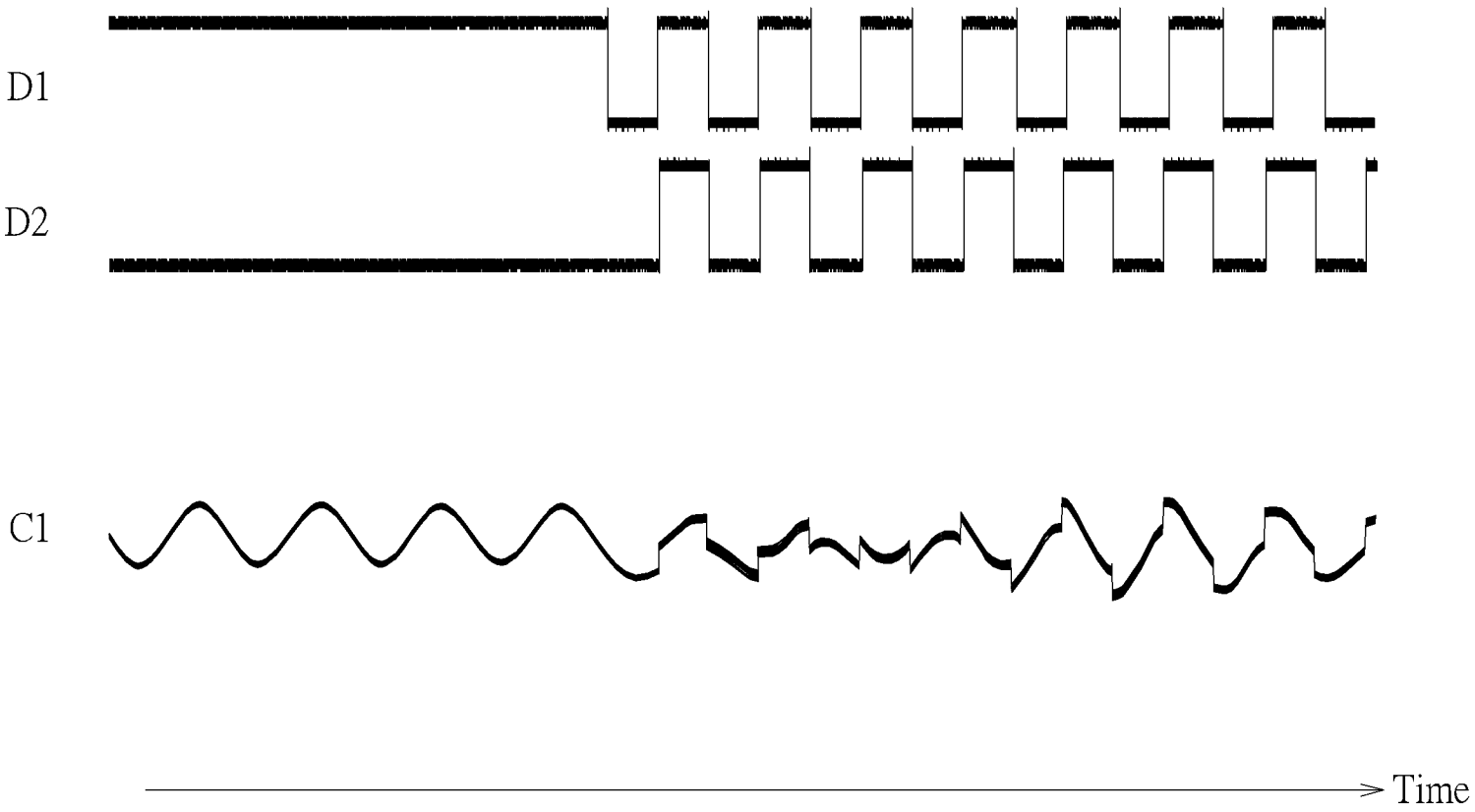
FIG. 11 is a schematic diagram of starting the driving signals in a phase-shift manner according to an embodiment of the present invention.

Please note that after the driving signals D1 and D2 are interrupted and whether there is an intruding metal in the power transmission region of the induction type power supply system 100 is determined, the driving signals D1 and D2 may restart in a phase-shift manner, in order to prevent circuit components from being burnt out due to instant and significant rising of the amplitude of the coil signal C1. Please refer to FIG. 11, which is a schematic diagram of starting the driving signals D1 and D2 in the phase-shift manner according to an embodiment of the present invention. As shown in FIG. 11, the driving signals D1 and D2 stay on the high voltage level and low voltage level, respectively, when interrupted. When the driving signals D1 and D2 restart, the driving signal D1 is switched to the low voltage level, and then the driving signals D1 and D2 are switched to the high voltage level simultaneously. At this moment, the driving signals D1 and D2 are in the same phase, which may not generate resonant effects; hence, the amplitude of the coil signal C1 may not rise significantly. Subsequently, the clock generator 112 gradually adjusts any one or both of the phases of the driving signals D1 and D2, until the phase of the driving signal D1 and the phase of the driving signal D2 become opposite. For example, the clock generator 112 may fine tune the time points of switching the driving signals D1 or D2, allowing these two driving signals D1 or D2 to reach opposite phases gradually. After the phase adjustment starts, the driving capability of the driving signals D1 and D2 may increase gradually, so that the driving effects realized by the resonant circuit of the supplying-end coil 142 may be enhanced gradually. This increases the amplitude of the coil signal C1. As a result, the phase-shift manner may prevent the circuit components from being burnt out due to instant and significant rising of the amplitude of the coil signal C1.

As can be seen from the above descriptions, the present invention can determine whether there is an intruding metal in the power transmission region of an induction type power supply system, which may be realized by detecting the status of the coil signal attenuation. Those skilled in the art can make modifications and alternations accordingly. For example, the structure of the supplying-end processor 11 shown in FIG. 1 is only one of various implementations. In practice, the modules such as the clock generator 112, the voltage generator 113, the comparator 114 and the voltage detector 115 may be included in the supplying-end processor 11, or may be respectively disposed in the supplying-end module 1. The implementations of each module should not be limited to the scope described in this disclosure. As mentioned above, the supplying-end module 1 may include any number of voltage generators and comparators according to requirements of sensing the intruding metal. For example, if a sensing requirement is to determine the existence of the intruding metal only, one voltage generator and one comparator are enough to meet this requirement. If a sensing requirement needs to determine the size or type of the intruding metal, multiple voltage generators and comparators may be disposed to perform the determination. Multiple voltage generators and comparators may also be used for enhancing the accuracy of the determination. In addition, in the above embodiments, the two driving signals D1 and D2 stay in different voltage levels when the driving of coil is interrupted, but in another embodiment, the two driving signals D1 and D2 may both stay in the high voltage level or the low voltage level when the driving of coil is interrupted; this is not limited herein. Furthermore, the above embodiments aim at detecting the attenuation speed of the coil signals to determine whether there is an intruding metal. In practice, instead of detecting the attenuation speed, the embodiments of the present invention may also determine the intruding metal by detecting other attenuation characteristics such as the falling slope of peak values or attenuation acceleration. In an embodiment, the supplying-end processor 11 may also include a memory, for storing the attenuation pattern of various intruding metals to be used for comparison and matching with the detected attenuation pattern.

Please note that, even if the intruding metal is very small, the intruding metal may still affect the attenuation status of the coil signal when the driving of coil is interrupted as long as the intruding metal enters the power transmission region of the induction type power supply system. Therefore, the present invention may detect a tiny intruding metal such as a coin, key or paper clip. In addition, even when the output power varies, the same intruding metal may still result in signal attenuation with similar pattern and similar speed. In such a condition, the intruding metal detection method of the present invention can be applied to an induction type power supply system having any output power values. Therefore, the increase in power value setting of the induction type power supply system will not be limited due to the problem where the threshold value of power loss for the intruding metal detection is not easily determined as in the prior art. In addition, the intruding metal detection method of the present invention can be realized in the power supply terminal only, and can be adapted to any receiving-end modules manufactured by different manufacturers; that is, the intruding metal detection method of the present invention implemented in the power supply terminal has no compatibility problems with the power receiving terminal. Furthermore, the coil signal attenuation due to interruption on the driving of coil signal is not easily affected by receiving-end loads, output power magnitudes and/or other interferences, and the corresponding threshold value may be accurately configured, allowing the existence of tiny intruding metals to be effectively determined. Another benefit of the present invention includes that, the intruding metal detection method can only be realized by software control in the supplying-end processor, where no additional hardware circuit is required. The circuit costs can thereby be under control.

To sum up, the present invention may determine whether an intruding metal exists in the power transmission region of an induction type power supply system by detecting an attenuation status of the coil signal on the supplying-end coil. In order to achieve an accurate intruding metal detection, the driving signal may be interrupted to stop driving the supplying-end coil during coil driving operations. The attenuation status of the coil signal may be detected when the driving is interrupted, and whether an intruding metal exists can thereby be determined. As a result, the intruding metal detection method with higher accuracy can be realized; this enhances the protection effects on the induction type power supply system. In addition, tiny intruding metals may also be detected according to the intruding metal detection method of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method used for an induction type power supply system, for detecting whether an intruding metal exists in a power transmission region of the induction type power supply system, the method comprising:

interrupting at least one driving signal of the induction type power supply system to stop driving a supplying-end coil of the induction type power supply system;

detecting an attenuation status of a coil signal on the supplying-end coil when driving of the supplying-end coil is interrupted; and determining whether the intruding metal exists in the power transmission region of the induction type power supply system according to the attenuation status of the coil signal;

wherein the step of determining whether the intruding metal exists in the power transmission region of the induction type power supply system according to the attenuation status of the coil signal comprises:

configuring a threshold voltage;

calculating a number of peaks reaching the threshold voltage in the coil signal after the at least one driving signal is interrupted; and determining that the intruding metal exists in the power transmission region of the induction type power supply system when the number is smaller than a threshold value.

2. The method of claim 1, wherein the step of determining whether the intruding metal exists in the power transmission region of the induction type power supply system according to the attenuation status of the coil signal comprises:

determining that the intruding metal exists in the power transmission region of the induction type power supply system when an attenuation speed of the coil signal is greater than a threshold value.

3. The method of claim 1, wherein the step of calculating the number of peaks reaching the threshold voltage in the coil signal after the at least one driving signal is interrupted comprises:

enabling a counter when the at least one driving signal is interrupted;

detecting whether a peak of the coil signal reaches the threshold voltage during an oscillation cycle of the coil signal after enabling the counter;

increasing the counter by one when detecting that the peak of the coil signal reaches the threshold voltage, and then detecting whether another peak of the coil signal reaches the threshold voltage during a next oscillation cycle of the coil signal; and obtaining a counting result of the counter as the number of peaks reaching the threshold voltage in the coil signal when detecting that there is a peak of the coil signal failing to reach the threshold voltage.

4. A method used for an induction type power supply system, for detecting whether an intruding metal exists in a power transmission region of the induction type power supply system, the method comprising:

interrupting at least one driving signal of the induction type power supply system to stop driving a supplying-end coil of the induction type power supply system;

detecting an attenuation status of a coil signal on the supplying-end coil when driving of the supplying-end coil is interrupted; and determining whether the intruding metal exists in the power transmission region of the induction type power supply system according to the attenuation status of the coil signal, wherein the step of determining whether the intruding metal exists in the power transmission region of the induction type power supply system according to the attenuation status of the coil signal comprises:

configuring a threshold voltage;

measuring an attenuation period of the coil signal after the at least one driving signal is interrupted, wherein the attenuation period starts when the at least one driving signal is interrupted and ends when there appears a peak of the coil signal failing to reach the threshold voltage; and determining that the intruding metal exists in the power transmission region of the induction type power supply system when the attenuation period is shorter than a threshold value.

5. The method of claim 4, wherein the step of measuring the attenuation period of the coil signal after the at least one driving signal is interrupted comprises:

enabling a timer when the at least one driving signal is interrupted;

detecting whether a peak of the coil signal reaches the threshold voltage during an oscillation cycle of the coil signal after enabling the timer;

after detecting that the peak of the coil signal reaches the threshold voltage, detecting whether another peak of the coil signal reaches the threshold voltage during a next oscillation cycle of the coil signal; and stopping the timer and obtaining a timing result of the timer as the attenuation period of the coil signal when detecting that there is a peak of the coil signal failing to reach the threshold voltage.

6. A method used for an induction type power supply system, for detecting whether an intruding metal exists in a power transmission region of the induction type power supply system, the method comprising:

interrupting at least one driving signal of the induction type power supply system to stop driving a supplying-end coil of the induction type power supply system;

detecting an attenuation status of a coil signal on the supplying-end coil when driving of the supplying-end coil is interrupted; and determining whether the intruding metal exists in the power transmission region of the induction type power supply system according to the attenuation status of the coil signal, wherein the step of determining whether the intruding metal exists in the power transmission region of the induction type power supply system according to the attenuation status of the coil signal comprises:

configuring a plurality of threshold voltages;

obtaining an attenuation pattern of the coil signal according to attenuation periods of peaks of the coil signal respectively attenuating to the plurality of threshold voltages; and determining whether the intruding metal exists in the power transmission region of the induction type power supply system and determining a type or size of the intruding metal according to the attenuation pattern.

7. A method used for an induction type power supply system, for detecting whether an intruding metal exists in a power transmission region of the induction type power supply system, the method comprising:

interrupting at least one driving signal of the induction type power supply system to stop driving a supplying-end coil of the induction type power supply system;

detecting an attenuation status of a coil signal on the supplying-end coil when driving of the supplying-end coil is interrupted;

determining whether the intruding metal exists in the power transmission region of the induction type power supply system according to the attenuation status of the coil signal; and starting the at least one driving signal in a phase-shift manner after determining whether the intruding metal exists in the power transmission region of the induction type power supply system;

wherein the step of starting the at least one driving signal in the phase-shift manner comprises:

starting the at least one driving signal wherein a phase of a first driving signal and a phase of a second driving signal among the at least one driving signal are the same; and gradually adjusting one or both of the phases of the first driving signal and the second driving signal, until the phase of the first driving signal and the phase of the second driving signal are opposite.

8. A method used for an induction type power supply system, for detecting whether an intruding metal exists in a power transmission region of the induction type power supply system, the method comprising:

interrupting at least one driving signal of the induction type power supply system to stop driving a supplying-end coil of the induction type power supply system;

detecting an attenuation status of a coil signal on the supplying-end coil when driving of the supplying-end coil is interrupted;

determining whether the intruding metal exists in the power transmission region of the induction type power supply system according to the attenuation status of the coil signal; and detecting a peak voltage of the coil signal and configuring at least one threshold voltage according to the peak voltage, wherein the at least one threshold voltage is used for determining whether the intruding metal exists in the power transmission region of the induction type power supply system;

wherein the at least one threshold voltage is smaller than the peak voltage.

* * * * *